United States Patent [19]

Copp

[11] 4,244,498

[45] Jan. 13, 1981

[54] SKI BOOT CADDY

[76] Inventor: Robert D. Copp, 5068 Glen Verde Dr., Bonita, Calif. 92002

[21] Appl. No.: 69,808

[22] Filed: Aug. 27, 1979

[51] Int. Cl.[3] ..... A47F 7/08; B65D 63/10

[52] U.S. Cl. ..... 224/45 P; 224/49; 224/55

[58] Field of Search ..... 224/45 P, 45 S, 49, 224/55, 58, 250, 921

[56] References Cited

U.S. PATENT DOCUMENTS

| | | | |
|---|---|---|---|
| 398,902 | 3/1889 | Payne | 224/49 X |
| 1,611,455 | 12/1926 | Keeler | 224/55 |
| 2,428,074 | 9/1947 | Hanson | 224/250 X |
| 2,679,937 | 6/1954 | Fulster | 224/250 X |
| 3,086,806 | 4/1963 | McAndrew | 224/45 P |
| 3,653,565 | 4/1972 | McAusland | 224/45 S X |
| 3,709,545 | 1/1973 | Oltmanns | 224/45 P X |

FOREIGN PATENT DOCUMENTS

| | | | |
|---|---|---|---|
| 758694 | 10/1956 | United Kingdom | 224/45 P |

*Primary Examiner*—Steven M. Pollard
*Attorney, Agent, or Firm*—Ralph S. Branscomb

[57] ABSTRACT

A simplified ski boot caddy is provided having an inverted U-shaped handle of molded plastic, or the like, which at the ends thereof articulates expanded tip catch elements which are selectively engaged in holes in a pair of flexible support straps so that the straps may be pivoted outwardly to engage the tops of the arch portions of ski boots. The straps are adjustable to accommodate boots of different size.

2 Claims, 8 Drawing Figures

SKI BOOT CADDY

BACKGROUND OF THE INVENTION

The transportation of ski equipment to and from the ski slopes and the alternation of actual skiing time with periods used for rest and socialization have engendered the popularity of the ski boot carrier to the point where it is virtually essential. Numerous types of carriers have been provided, most of which involve the utilization of a vertical center slat which has a boot pressed against each side of it, with the boots being retained by bails or other structures which engage the head and the same toe portion of the boot sole which is engaged by the ski.

These prior art devices are in many instances very secure and durable, but suffer from the drawbacks of being unnecessarily expensive, heavy, and unnecessarily large and awkward when not in use. They are ordinarily large enough and heavy enough that they could not be carried with the skier as he goes up the slopes, and thus he must insure that it is in a safe place where it is not subject to theft while he is skiing.

There is a need for a simplified version of a ski carrying device to replace the somewhat elaborate and complicated structure unnecessarily incorporated in conventional devices used to tote skis.

SUMMARY OF THE INVENTION

The present invention fulfills the above mentioned need by providing a very simple, extremely inexpensive, and yet fool-proof device capable of carrying ski boots of any size and sufficiently lightweight to be carried in the back pocket or "fannie pack" of the skier while he is on the slopes.

The device utilizes a simple handle having depending sides which have nipple detents on the ends which engage holes provided in a pair of identical flexible straps which engage respectively the outside of the boot arch of a pair of ski boots having the soles pressed together. Each of the straps is adjustable by means of alternate holes to engage the handle nipples, or by virtue of being made from two slidingly adjustable overlapping strap halves that can be secured in one of several lengths.

When not in use, the three simple pieces of the device can be dismantled entirely and completely nested or, inasmuch as they are pivotally interconnected, they can be swiveled to lie in the same plane, occupying a small space and presenting almost no weight to the skier.

DETAILED DESCRIPTION OF THE PREFERRED EMBODIMENTS

Figure 1:
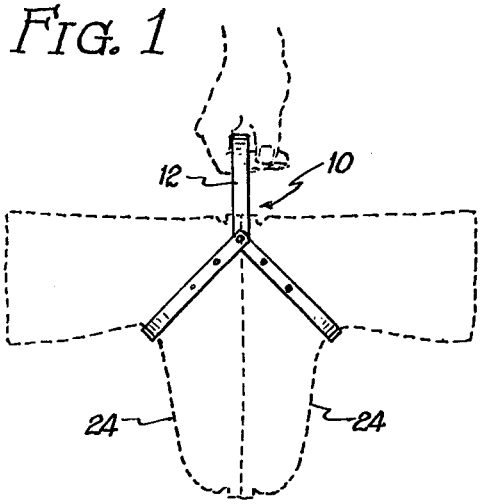
FIG. 1 is a side elevation view showing the device in use carrying a pair of ski boots.
Figure 2:
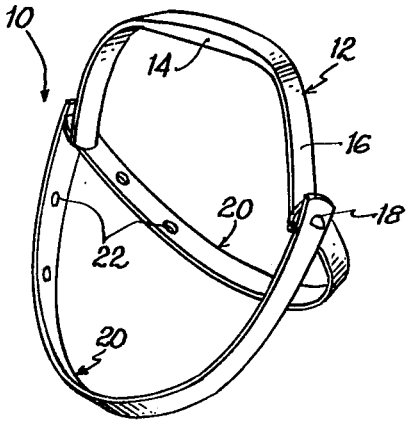
FIG. 2 is a perspective view of the device in its deployed position but without ski boots.
Figure 3:
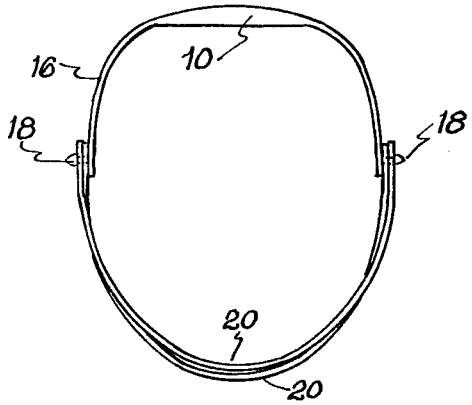
FIG. 3 is a front elevation view of the device with the straps collapsed.
Figure 4:
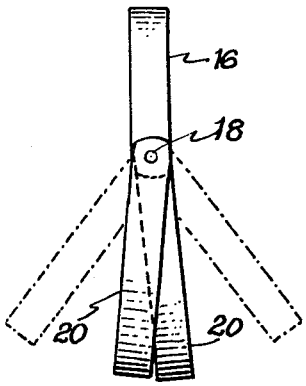
FIG. 4 is a side elevation showing the carrying straps swung between their deployed and collapsed position.
Figure 5:
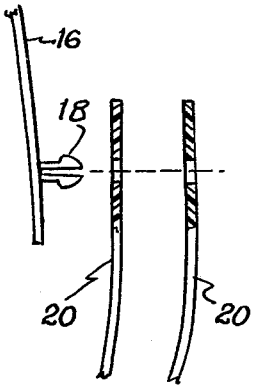
FIG. 5 is a detail of the detent nipple showing its engagement with holes in the carrying straps.

The ski boot caddy is shown at 10 having a handle element 12 with a thickened, reinforced grip 14 and depending sides 16. The handle is form-retaining if not absolutely rigid, and at the ends is provided with a pair of expanded tipped nipple detents 18 which are used to releasably engage boot straps 20 through holes 22 provided in the ends of each of the straps. The straps are ideally of a lightweight, resilient plastic material, and could be completely flexible and fabricated in fiberglass cloth, for example.

It can be seen from FIG. 1 that when the straps are pivoted outwardly, they can be used to engage the top arch portion of the ski boots 24 and provided only that the appropriate length of strap is provided to insure that the inward force vectors applied to the boots are directed adequately centrally to prevent escape of the boots through the bottom opening, the boots are stable in the caddy. In order to adjust the strap length to control the above-described vectors the holes 22 are provided in one end of each strap as spaced alternatives as shown in FIG. 1. The straps are released by popping them back over the detents 18 and engaging a different hole, if desired.

Figure 6:
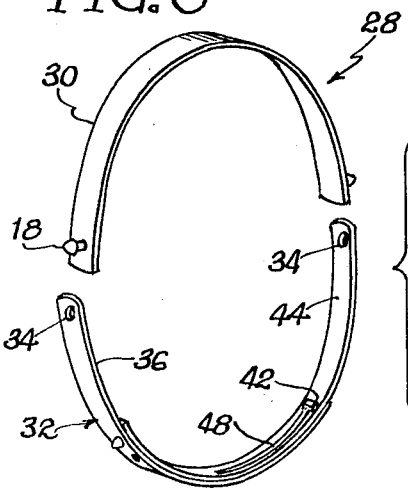
FIG. 6 is a perspective of a modified strap and handle.
Figure 7:
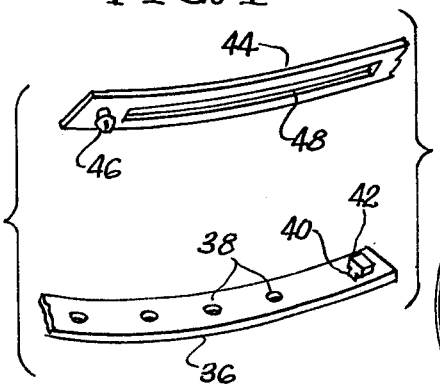
FIG. 7 is a perspective detail illustrating the mating elements of the half straps of the embodiment of FIG. 6.

A second embodiment of the invention is shown in FIGS. 6 and 7 wherein a caddy 28 utilizes a flexible handle 30 having the same detents 18 which engage straps 32 by the holes 34. There are of course two of these straps, although only one has been shown for clarity.

Figure 8:
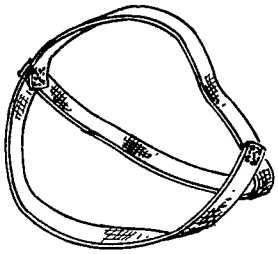
FIG. 8 is a modification where the simple flexible strap is used.

These straps 32 are each comprised of two half straps, a left half strap 36 having a plurality of spaced central holes 38 therein with a key 40 at the end, this key having a short laterally extended panel 42 at the end thereof. The right half strap 44 has a nipple detent 46 similar to detent 18 and an elongated slot 48. It can be seen from FIG. 7 that the end of the right half strap 44 can be brought down across the key 40 so that the panel 42 passes through the slot 48, which can only happen when the half straps are perpendicular. When turned parallel, the panel 42 securely engages the right strap half 44 so that the straps can mutually longitudinally slide relative to one another. The nipple 46 can then be selectively engaged in any one of the several holes 38, so that the length of the entire strap can be adjusted. Other variations are of course possible within the spirit of the invention and the scope of the appended claims, and another variation is shown at FIG. 8 wherein a single flexible strap may have fiberglass cloth or the like can be used. This implementation is of course similar than the above-described caddy, but suffers from certain defects vis-a-vis the semi-rigid type described above in the areas of stability and adjustability.

The invention in any of its disclosed embodiments represents a major departure from the prior art ski boot carrying field, and enable the user with a minimum of cost, weight disability or inconvenience to be able to wear his boots or carry them, and the device can be used if desired to carry conventional shoes or boots while the ski boots are being worn, a capability not possible with most ski boot carriers which are adapted to engaging the specific structure of the ski boot especially designed to be engaged by the ski.

What is claimed is:

1. A ski boot caddy comprising:

(a) an inverted U-shaped handle;

(b) a pair of straps pivoted at the respective ends thereof to the ends of said handle such that said straps can be pivoted outwardly to engage the tops of the arches of a pair of ski boots with the soles pressed together, or alternatively pivoted into a compact form substantially aligned with said handle when said caddy is not in use;

(c) each of said straps comprising a pair of adjustable lapped half straps with means to selectively engage the half straps in each pair together to define any one of several lengths; and, (d) one of the half straps of each pair being provided with a longitudinal slot and a nipple projection and the other half strap of each pair being provided with a key to engage said slot and a plurality of longitudinally spaced holes to be selectively engaged by said nipple.

2. The structure according to claim 1 wherein said key has a transversely extended detent panel spaced from the respective half straps whereby said key can be inserted through said slot when said half straps are perpendicular but said half straps cannot be spaced when parallel.

* * * * *